United States Patent [19]

Kanemitsu et al.

[11] Patent Number: 4,676,498

[45] Date of Patent: Jun. 30, 1987

[54] SHEET FEEDING APPARATUS

[75] Inventors: Shinji Kanemitsu, Ichikawa; Mototada Toriumi, Yokohama, both of Japan

[73] Assignee: Canon Kabushiki Kaisha, Tokyo, Japan

[21] Appl. No.: 903,847

[22] Filed: Sep. 5, 1986

Related U.S. Application Data

[63] Continuation of Ser. No. 558,007, Dec. 5, 1983, abandoned.

[30] Foreign Application Priority Data

Dec. 10, 1982 [JP] Japan ..... 57-216385

[51] Int. Cl.[4] ..... B65H 9/16

[52] U.S. Cl. ..... 271/251; 271/226; 271/229

[58] Field of Search ..... 271/226, 227, 228, 229, 271/230, 236, 238, 240, 242, 248, 249, 250, 251, 252, 264, 272, 273, 274

[56] References Cited

U.S. PATENT DOCUMENTS

| | | | |
|---|---|---|---|
| 1,531,883 | 3/1925 | Smith | 271/250 |
| 2,083,296 | 6/1937 | Davidson | 271/248 |
| 2,273,289 | 2/1942 | Rouan | 271/248 |
| 2,302,060 | 11/1942 | Ryan | 271/274 |
| 2,368,098 | 1/1945 | Belluche | 271/252 |
| 2,400,927 | 5/1946 | Harrold | 271/252 |
| 2,555,913 | 6/1951 | Backhouse | 271/252 |
| 2,712,936 | 7/1955 | Backhouse | 271/252 |
| 3,741,536 | 6/1973 | Anderson | 271/226 |
| 4,049,256 | 9/1977 | Church et al. | 271/251 |
| 4,051,779 | 10/1977 | Zaagman | 271/226 |
| 4,266,762 | 5/1981 | Kramer et al. | 271/251 |
| 4,438,918 | 3/1984 | Ito et al. | 271/251 |
| 4,482,147 | 11/1984 | Hibi et al. | 271/251 |

FOREIGN PATENT DOCUMENTS

| | | | |
|---|---|---|---|
| 0062139 | 4/1982 | Japan | 271/251 |
| 0090343 | 6/1982 | Japan | 271/251 |
| 0141333 | 9/1982 | Japan | 271/273 |
| 566455 | 1/1945 | United Kingdom | 271/250 |

OTHER PUBLICATIONS

*Xerox Disclosure Bulletin*, vol. 5, No. 6, Nov./Dec. 1980, p. 585, Acquarva, Thomas, "Inchworm Platen Transport".

*Primary Examiner*—Duane A. Reger
*Assistant Examiner*—Matthew C. Graham
*Attorney, Agent, or Firm*—Fitzpatrick, Cella, Harper & Scinto

[57] ABSTRACT

The present invention provides a sheet feeding apparatus for moving a sheet in a predetermined direction, characterized by a guide located at the lateral side of the path for the sheet, a conveyor for conveying the sheet along the guide, and a flexure inhibiting member for holding down the sheet.

12 Claims, 13 Drawing Figures

SHEET FEEDING APPARATUS

This application is a continuation of application Ser. No. 558,007 filed Dec. 5, 1983, now abandoned.

BACKGROUND OF THE INVENTION

1. Field of the Invention

The present invention relates to a sheet feeding apparatus usable in image forming systems such as electrophotographic copying machines, microfilm instruments, facsimiles, laser-beam printers, ink-jet printers and so on. Particularly, the present invention provides a sheet feeding apparatus which can effectively return a moving sheet from its position out of the path to its position in line with the path and also which can feed the sheet under its stable condition without flexure.

The sheet feeding apparatus according to the present invention is adaptable not only to copy paper, photosensitive paper and the like, but also to a resinous sheet as used in an overhead type projector, for example. Furthermore, it may be applied to original documents or punch cards.

2. Description of the Prior Art

The prior art will now be described in connection with a sheet feeding apparatus which can manually feed sheets one at a time by the use of slantingly arranged feed rollers, for example, in an electrophotographic copying machine.

As shown in FIG. 1A, such a type of sheet feeding apparatus comprises a slantingly arranged feed roller R, a guide G (transfer sheet side constraint) for transfer sheets to be manually inserted and a detection lever L for discriminating the presence or absence of a transfer sheet. When a transfer sheet P is manually moved to the detection lever L, a holding-down roller (not shown) is moved downwardly toward the transfer sheet P. Thus, the transfer sheet P is conveyed while being held by the holding-down roller and the slantingly arranged feed roller R. The conveying force is considered to be a vector T in FIG. 1A. If there is an angle $\theta$ between the roller R and the direction of the moving sheet P, the transfer sheet P will be subjected to a force $T\sin\theta$ which acts to urge it against the guide G. If the transfer sheet P is relatively thin or very wet, and therefore less rigid, it will engage the guide G due to the force $T\sin\theta$ to produce a flexure and/or corrugation or wrinkle in the transfer sheet (FIG. 1B). After the transfer sheet has been fed to the transfer station under the above condition, the transfer of the image may be partly void, or the transfer sheet may be wrinkled so that the image may be reduced in quality. On the contrary, if the force T is set at less value to prevent such a flexure thicker paper or curled paper can not be fed in good order. The force $T\sin\theta$ may be decreased if the above angle $\theta$ is reduced. In this case, however, the slanted feed of the transfer sheet will not properly be corrected. As will be understood from the foregoing, there is an opposing interrelation between the proper function and/or conveying force of the slantingly arranged roller and the flexure in the transfer sheet. It is desired that the transfer sheet can be fed without any flexure while maintaining the proper correcting function and conveying force.

SUMMARY OF THE INVENTION

It is an object of the present invention to provide a sheet feeding apparatus which can effectively correct the movement of a sheet which is fed in a predetermined direction.

Another object of the present invention is to provide a sheet feeding apparatus which can feed a sheet without flexure or corrugation.

Still another object of the present invention is to provide a sheet feeding apparatus which can obtain sufficient conveying forces.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

Figure 1A:
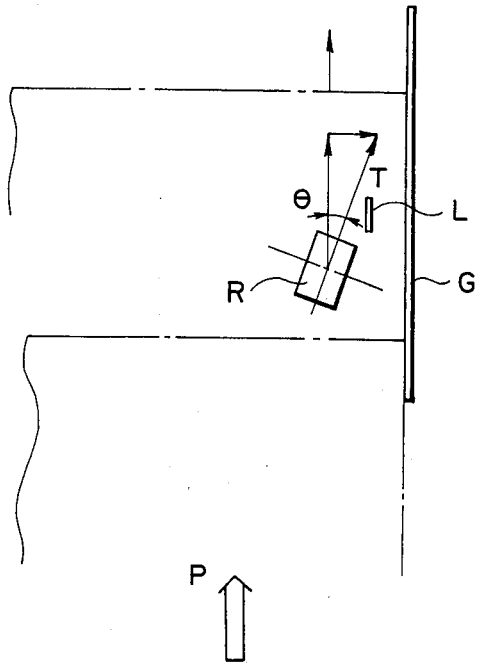
FIG. 1A PRIOR ART
FIGS. 1A and 1B are plan views illustrating the prior art manually sheet insertion type feed apparatus.
Figure 1B:
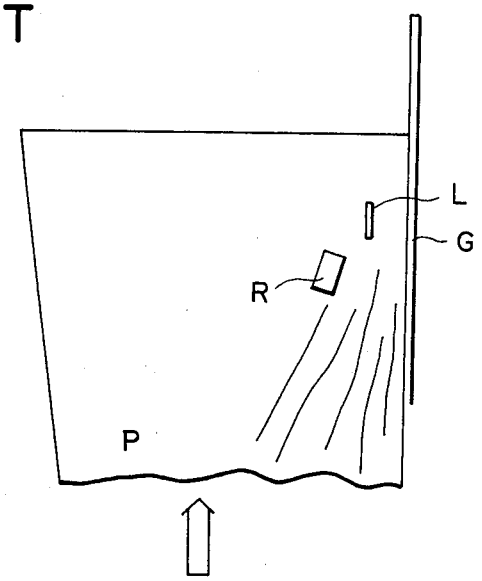
FIG. 1B PRIOR ART
Figure 2:
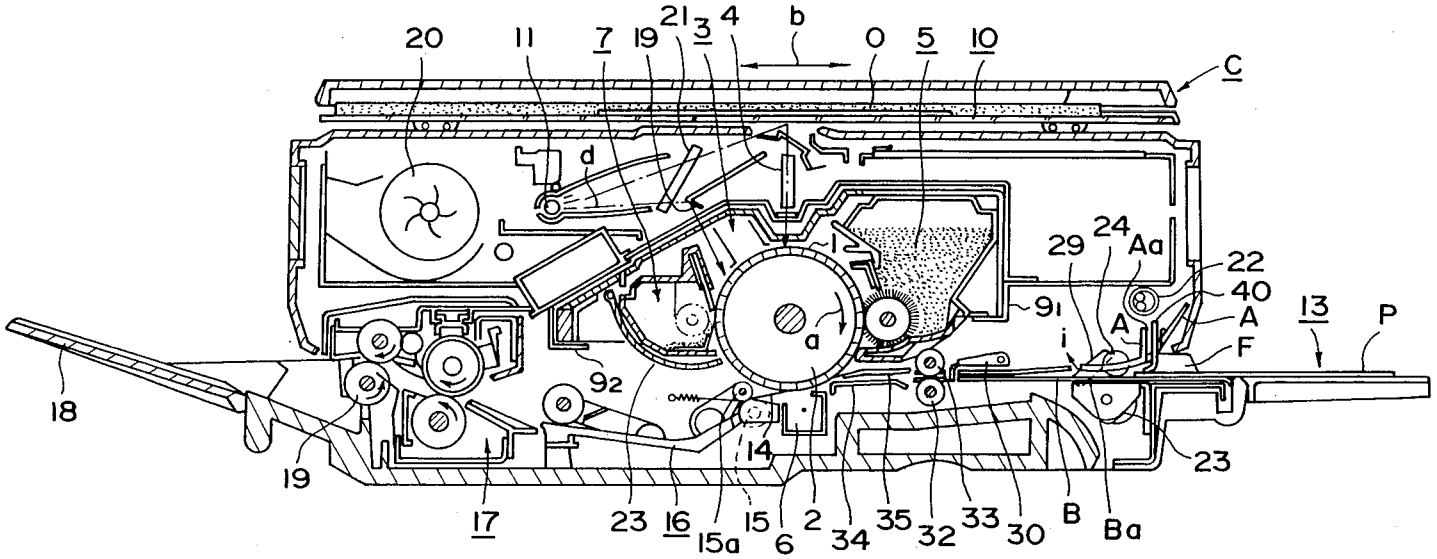
FIG. 2 is a cross-sectional view of an electrophotographic type copying machine to which an embodiment of the present invention is applied.

Referring to FIG. 2, an electrophotographic copying machine shown herein as a cross-sectional view comprises a photosensitive drum 2 including an electrically conductive drum body and a photoconductive layer 1, the drum being rotatable in the direction of arrow a. Around the drum 2 there are arranged a corona discharger 3, a short-focus imaging element array 4, a developing device 5, a transfer corona discharger 6 and a cleaner 7 in the order described in the direction of rotation.

In the above copying machine, the surface of the photosensitive drum 2 is first charged uniformly by means of the corona discharger 3 with a predetermined polarity. Then, an original O on an original carriage 10 reciprocable on the top of machine section in the direction of arrow b is illuminated by a halogen lamp 11 to form a reflective light to which the drum 2 is exposed through the short-focus imaging element array 4 to form a latent image thereon. The latent image is then visualized by the development device 5 to form a toner image on the drum 2. The toner image is transferred to a transfer sheet P under the action of a corona in the transfer discharger which has the same polarity as that of the primary discharger 3. Supposing that the transfer sheet P is manually supplied to the machine, an operator will insert a transfer sheet into the machine C through a manual insertion guide 13 until the transfer sheet engages a transfer-sheet flexure inhibiting member 40 to force it upwardly. The transfer sheet P is then fed to the transfer station by means of a slantingly arranged roller 23 and a holding-down roller 24. The transfer sheet P having the toner image thereon is then separated from the photosensitive drum 2 by means of a strap-like separation belt 14, a separation roller 15 and a driven roller 15*a* all of which are disposed beside the path of the transfer sheet. Thereafter, the transfer sheet P is fed to a fixing device 17 under the action of a conveying section 16. The separation belt 14 is positioned between the surface of the drum 2 and the side margin of the transfer sheet P which is at the transfer station so that the transfer sheet P will be guided away from the drum 2 as the former is being moved forwardly. The so guided sheet P is grasped and conveyed between the separation roller 15 and the driven roller 15*a* such that the transfer sheet P will be stripped off the peripheral surface of the drum 2. The separation belt 15 is tensioned by a spring 14*b* to partially engage the drum adjacent the lateral end thereof under pressure.

After the transferred image on the transfer sheet P has been fixed thereto by the fixation device 17, the transfer sheet is finally discharged into a sheet receiving tray 18 as a finished copy under the action of discharging rollers 19.

After completion of the transfer step, the remaining toner particles on the photosensitive drum 2 are removed by the cleaner 7. The drum 2 is then made uniform with respect to potential under the influence of a pre-exposure light shown by two-dot chain line d in FIG. 2 which is formed by dividing a light from the halogen lamp 11 as a source of image exposure light with the divided light portion being introduced onto the surface of the photosensitive drum 2 through a reflection mirror 19. The photosensitive drum 2 is then advanced to the primary discharger 3. If it is desired to form a plurality of copies, the above cycle will be repeated. The machine further comprises a ventilating fan 20 and a heat radiation absorbing filter 21.

Referring to FIGS. 2 to 5A and 5B, the manual sheet insertion process according to the principle of the present invention will be described in detail.

The manual insertion guide 13 for facilitating the manual insertion of the transfer sheet P is provided at a sheet inlet F. A lateral or width guide 13*a* is located along a lateral reference line and fixedly secured to the side margin of a lower guide B which is disposed below the path of transfer sheet. The transfer sheet P is manually inserted into the machine on the manual sheet insertion guide 13 along the lateral guide 13*a* and then engages the transfer-sheet flexure inhibiting member 40 to move to upwardly. Thus, the transfer sheet P moves into the machine between an upper guide A and the lower guide B. Thereafter, the transfer sheet P reaches a slantingly arranged roller 23 angularly located relative to the path of the transfer sheet by an angle $\theta$ for positively guiding the transfer sheet P along the lateral guide 13*a*. This roller 23 is preferably made of a resilient material such as rubber or the like which has less difference between its coefficients of static and dynamic frictions. The roller 23 is drived through a gear train (not shown). The above angle $\theta$ is in the order of about 15° to 30° and properly selected depending upon the materials of the transfer sheets and roller 23. In the illustrated embodiment, the best results was obtained if transfer sheets of about 40 g/m$^2$–1200 g/m$^2$ were used and the slantingly arranged roller was made of "NOSRORAN" (trade mark) manufactured by Toshin Rubber Chemical Company.

Figure 3:
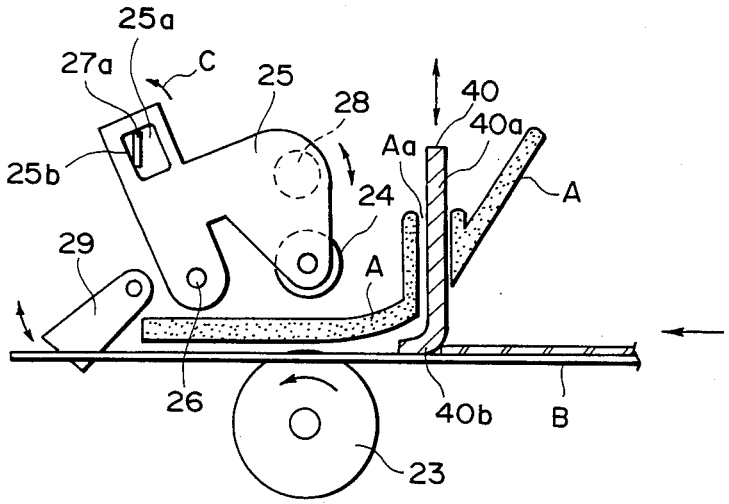
FIGS. 3 and 4 are cross-sectional views showing a flexure inhibiting member according to the present invention.
Figure 4:
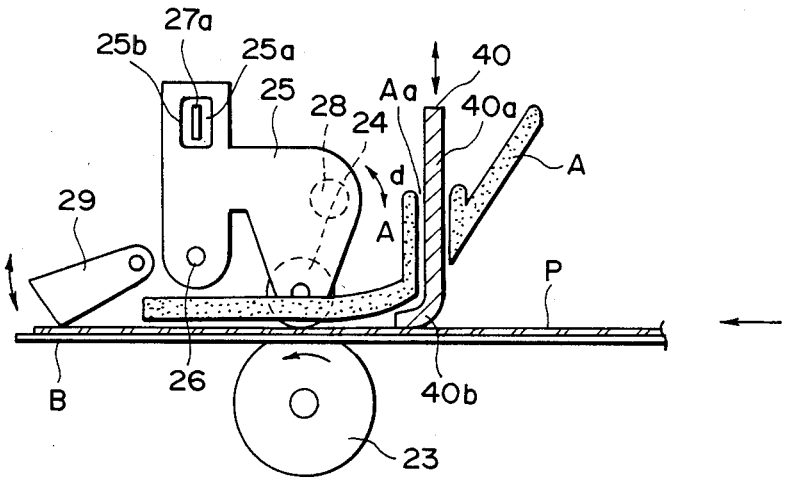

Above the slantingly arranged roller 23, there is located a holding-down roller 24 rotatably supported on a support 25 (see FIGS. 3 and 4). The support 25 is mounted on the machine C to swing about a shaft 26. The other end of the support 25 is provided with an opening 25*a* through which an actuator 27*a* of a plunger 27 extends. This actuator 27*a* normally urges the end portion 25*b* of the opening 25*a* in the counterclockwise direction with respect to the shaft 26 as shown by arrow C in FIG. 3. In other words, the support 25 is constrained by the actuator 27*a* such that the support will not be rotated clockwise. Thus, the slantingly arranged roller 23 will normally be apart from the holding-down roller 24.

As the inserted transfer sheet P is detected by a detection lever 29 which will be described hereinafter, this lever produces a detection signal which is in turn used to actuate the plunger to attract the actuator 27*a*. As a result, the actuator 27*a* is separated from the end portion 25*b* of the opening 25*a* so that the support 25 will be moved clockwise as shown by arrow d under the influence of a weight 28 secured to the support 25. Consequently, the holding-down roller 24 will be moved downwardly to engage the slantingly arranged roller 23. When the slantingly arranged roller 23 begins to rotate in response to a detection signal, the transfer sheet P is fed forwardly through the nip between those rollers 23 and 24.

Namely, as the leading edge of the transfer sheet P reaches a feed detection lever 29, the latter is upwardly moved by the transfer sheet P to generate the above detection signal which is in turn used to turn the copying machine on. Thus, the original carriage 10 begins to reciprocate and at the same time the slantingly arranged roller 23 begins to rotate. Simultaneously, the plunger 27 is turned on so that the actuator 27*a* thereof is separated from the end portion 25*b* of the opening 25*a* and the holding-down roller 24 will ride on the transfer sheet P. As a result, the transfer sheet P is slantingly conveyed toward the lateral guide 13*a* under the influence of the rollers 23 and 24 to engage the right-hand leading corner of the transfer sheet with the lateral guide 13*a* before the transfer sheet reaches the separation belt 14*a*. Since the flexure inhibiting member 40 engages the transfer sheet P by its weight in the illustrated embodiment, the transfer sheet P will not produce a flexure or corrugation on itself. With the moment of force, the transfer sheet P is properly and positively fed to the separation belt 14*a* so that the transfer sheet P will positively be separated from the drum 2. If the transfer sheet P reaches a shutter 30, the transfer sheet P is stopped by engaging the leading edge thereof with the shutter 30. At this time, the slantingly arranged roller 23 continues to rotate with slippage against the underside of the transfer sheet P. However, the plunger 27 is turned off, and the holding-down roller 24 is lifted back upwardly. With a timing at which the leading edge of the transfer sheet P is to be registered with the image on the photosensitive drum 2, the shutter 30 is opened immediately after the plunger has been turned on, and the holding-down roller 24 is again moved downwardly. As a result, the transfer sheet P can be moved to the nip between a pair of conveying rollers 32 and 33 by the cooperation of the slantingly arranged roller 23 with the holding-down roller 24. The transfer sheet P is then fed onto the surface of the drum 2 by the cooperation of the rollers 32 and 33 through a pair of guides 34 and 35. Since the transfer sheet P has been moved to the peripheral surface of the drum 2 along a predetermined path defined by the lateral guide 13*a*, the transfer sheet P is necessarily placed over the separation belt 14*a* which is inside of the lateral guide 13*a*. After the toner image on the drum 2 has been transferred to the transfer sheet P, the latter is guided away from the peripheral surface of the drum 2 under the action of the separation belt 14*a*. Thereafter, the transfer sheet P is completely stripped from the drum 2 by the separation roller 15 and the driven roller 15*a*.

If the transfer sheet P is not properly inserted into the proper path in which an oblique paper can be corrected by the slantingly arranged roller 23 and the holding-down roller 24, the detection lever 29 is not actuated so that the copying machine is not turned on, and therefore no operation of the slanted roller 23, no lowering of the roller 24 or no image forming operation takes place.

Figure 5A:
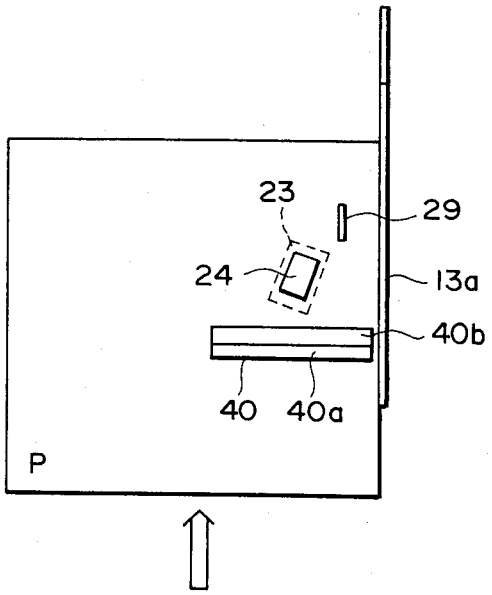
FIG. 5A is a plan view of the flexure inhibiting member.
Figure 5B:
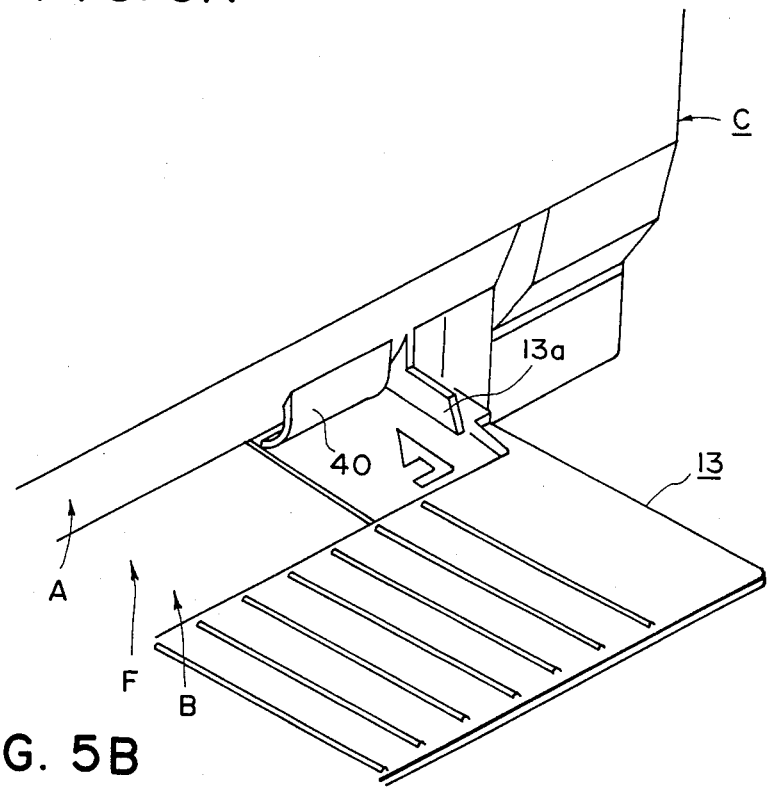
FIG. 5B is a perspective view of a sheet inlet.

In the illustrated embodiment, the transfer-sheet flexure inhibiting member 40 is disposed upstream of the slantingly arranged roller 23. This flexure inhibiting member 40 is in the form of a rectangular and flat plate 40*a* made of a synthetic resin such as ABS, polyacetal or the like. This flat plate is so mounted that it can move vertically relative to the upper guide A. If no transfer sheet is inserted into the machine C, the flexture inhibiting member 40 engages the lower guide B by its own weight. More particularly, the flexure inhibiting member 40 is slidably fitted into a vertical gap Aa formed in the upper guide A perpendicular to the path of the transfer sheet. The flexure inhibiting member 40 has its lower end 40*b* arcuately curved downstream along and across the path of the transfer sheet. FIG. 3 shows a state in which no transfer sheet is inserted into the machine while FIG. 4 shows a state in which a transfer sheet P is inserted into the machine. Further, FIG. 5A is a plan view showing the flat plate 40*a*, and FIG. 5B is a perspective view showing the sheet inlet F.

In the state shown in FIG. 3, if a transfer sheet P is manually inserted into the machine between the upper and lower guides A and B through the sheet inlet F, the leading edge of the transfer sheet P first engages the lower end 40*b* of the flexure inhibiting member 40 and is then allowed to pass under the lower end 40*b* along its arcuately curved shape. As a result, the flexure inhibiting member 40 is upwardly moved so that the transfer sheet P can reach the detection lever 29 to actuate it. Thus, the lever 29 generates a detection signal which is in turn used to energize the plunger 27 supporting the holding-down roller 24. Accordingly, the holding-down roller 24 is lowered to the transfer sheet P which will be held and conveyed between the holding-down roller 24 and the slantingly arranged roller 23 toward the interior of the machine C without any further manual assistance. Even if the holding-down roller 24 is designed to apply a sufficient force to the transfer sheet P so as to effectively correct the movement of the transfer sheet P, a possible flexure or corrugation thereof due to the engagement of the transfer sheet P with the lateral guide 13*a* does not occur since the transfer sheet P is downwardly forced by the inhibiting member. In such a manner, the gap between the upper and lower guides A and B can substantially be removed by the flexure inhibiting member 40 when the transfer sheet P is being moved in this gap. As a result, the possible corrugation or wrinkle of the transfer sheet P which may be caused by sheet buckling does not occur so that the transfer sheet can be maintained flat when being fed by the roller 23. Thus, stable manual paper feed operation having sufficient correction capability is made possible.

An numeral example of the present invention will be shown below.

For the proper correction of a manually fed transfer sheet along the predetermined path defined by the width guide 13, said angle $\theta$ must be 20 degrees or more. For the stable conveying of a specific transfer sheet such as thick paper, curled paper or the like under various conditions, the conveying force is needed to be equal to or larger than 30 g in the direction defined by $T\cos\theta$. Under such situations, if a transfer sheet decreased in thickness or rigidity is fed into the machine, it sometimes generates a flexure or corrugation without the flexure inhibiting member. However, if the flexure inhibiting member in the form of a flat plate which is 24 mm long and 35 mm width with its weight of about 2 g and having its lower end arcuately curved through length of about 8 was disposed spaced apart from the width guide 13*a* by about 0.5 mm and upstream from the holding-down roller 24 by about 15 mm, tracing paper of about 40 g/m$^2$, which is easily flexible, or a highly wet ordinary transfer paper of about 60 g/m$^2$ could properly be conveyed with no flexure or corrugation when it was manually inserted into the machine.

Figure 6A:
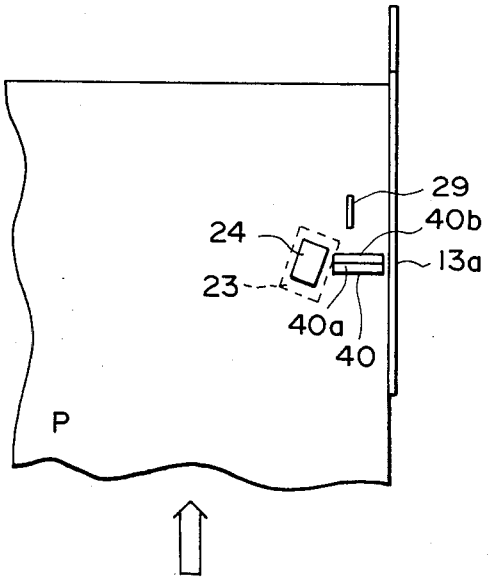
FIGS. 6A and 6B are plan views illustrating another embodiment of the present invention.
Figure 6B:
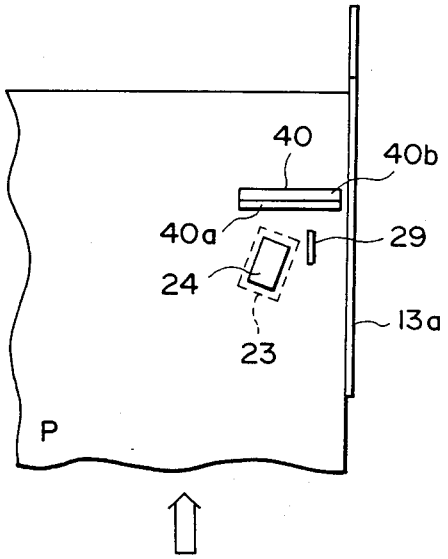

As shown in FIGS. 6A and 6B, the flexure inhibiting member 40 may be disposed beside or downstream of the slantingly arranged roller 23. The flexure or corrugation or buckling can be avoided in the transfer sheet being fed between the rollers 23 and 24 also by this arrangement. If the flexure inhibiting member 40 is disposed between the lateral guide 13*a* and the roller 23 as shown in FIG. 6A, a start of flexure occurrence can be inhibited so that the flexure or corrugation will more effectively be prevented. If the flexure inhibiting member 40 is disposed downstream of the roller 23 as shown in FIG. 6B, the flexure inhibiting member 40 can more positively be moved upwardly by the conveying force produced by the roller 23 and at the same time a start of flexure can also be inhibited.

Figure 7:
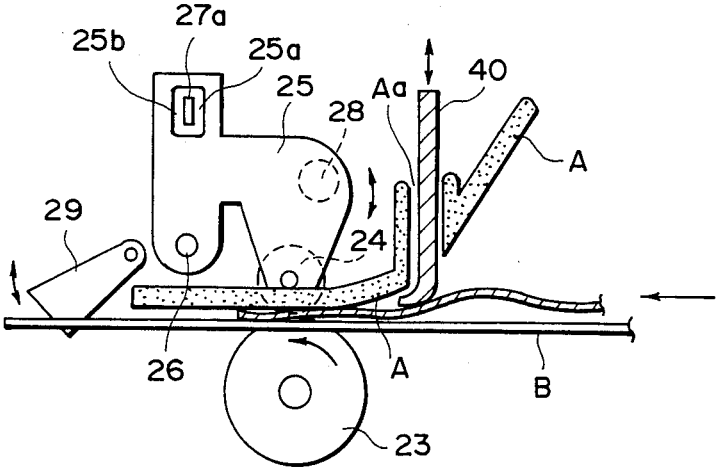
FIG. 7 is a cross-sectional view illustrating the condition under which a flexure is inhibited.

In the previously described embodiments, if a relatively thick or curled transfer sheet is manually supplied to the machine, as shown in FIG. 7, the flexure inhibiting member 40 is retracted vertically toward the upper guide A along the gap Aa depending on the condition of the transfer sheet so that there will not be produced an undesirable resistance to the transfer sheet.

Figure 8:
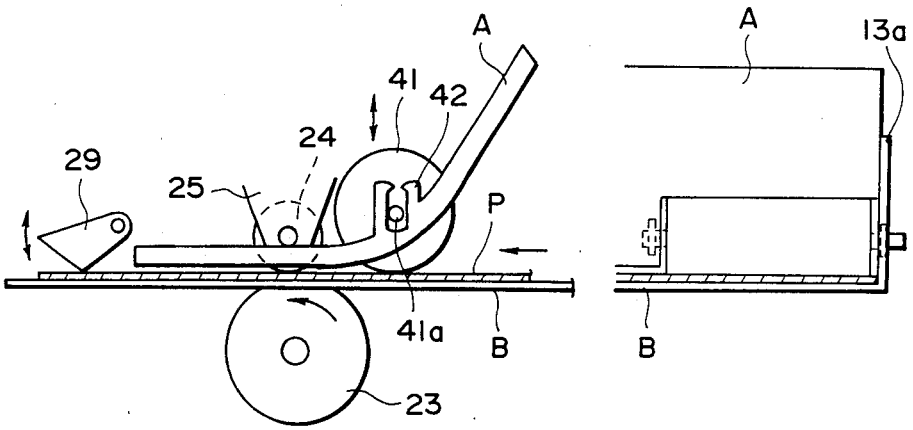
FIG. 8 is a side view of still another embodiment of the present invention.

Furthermore, the configuration of the flexure inhibiting member 40 may be of a rotary member 41 as shown in FIG. 8, rather than the form of a flat plate. This rotary member 41 is mounted to move vertically and engages the lower guide B by its own weight if no transfer sheet is supplied to the machine. If a transfer sheet is manually inserted into the machine, the flexure inhibiting member 41 is upwardly moved by the transfer sheet and at the same time freely rotated in rolling contact with the transfer sheet. The rotary member 41 includes a shaft 41*a* which is vertically movably and rotatably supported by a hook-shaped portion 42 in the upper guide A. In addition to the prevention of flexure or corrugation, the rotary member 41 can decrease any influence upon conveying the transfer sheet since the rotary member 41 is rotatably driven by the movement of the transfer sheet. In this manner, the insertion of transfer sheets can be facilitated due to the free rotation of the rotary member 41 with the operability of the machine being improved.

Figure 9:
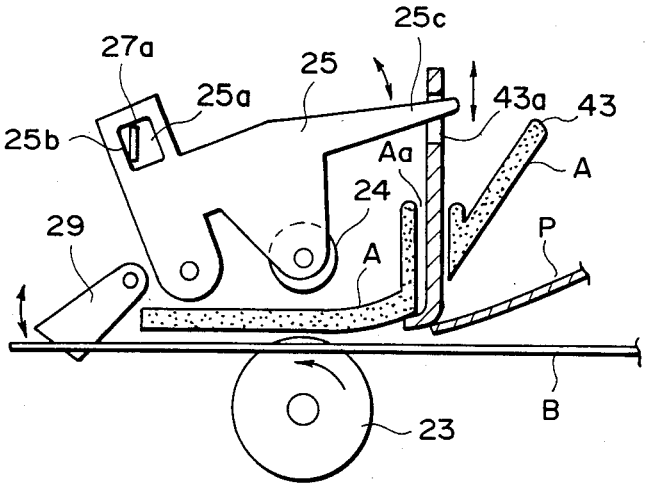
FIGS. 9 and 10 are cross-sectional views showing a further embodiment of the present invention.
Figure 10:
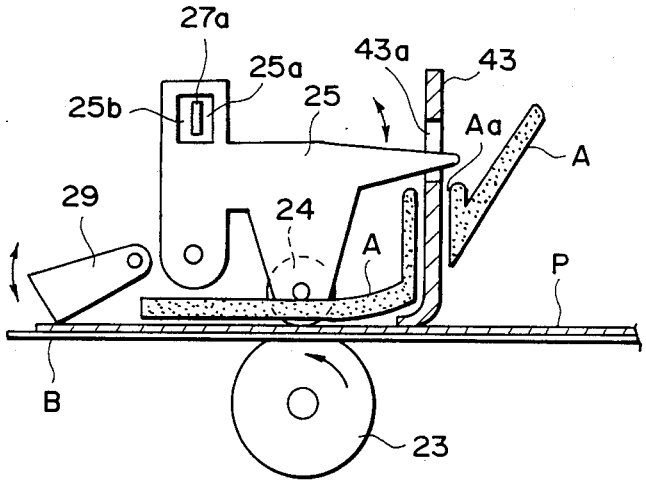

FIGS. 9 and 10 show a further embodiment of the present invention in which the manual sheet insertion can more easily be carried out.

Referring to FIG. 9, a flexure inhibiting member 43 is in the form of a flat plate and operably connected with the support 25 which supports the holding-down roller 24. The support 25 includes an arm 25*c* extending thereform into an opening 43*a* formed in the flexure inhibiting member 43. If no transfer sheet is inserted into the machine, the support 25 is urged upwardly under the action of the actuator 27*a* on the plunger. Since the arm 25*c* on the support 25 extends into the opening 43*a* in the flexure inhibiting member 43, the latter also is moved upwardly along the gap Aa in the upper guide A. Accordingly, the transfer sheet P can more easily inserted by the operator into the machine through the more opened gap between the lower guide B and the flexure inhibiting member 43. If the leading edge of the transfer sheet P reaches the detection lever 29 to produce a detection signal, the plunger is actuated in response to this detection signal to move its actuator 27*a* downwardly. As a result, the support 25 is permitted to move downwardly so that the holding-down roller 24 and thus the flexure inhibiting member 43 will be moved downwardly to properly convey the transfer sheet P while avoiding any flexure therein, as shown in FIG. 10.

In the embodiment shown in FIGS. 9 and 10, the transfer sheet P can more smoothly be inserted manually into the machine in spite of the presence of the flexure inhibiting member 43 since the transfer sheet will not be interferenced by the flexure inhibiting member 43.

Although the previous embodiments of the present invention have been described as having the separation belt, the present invention is not limited to such a structure. For example, a separation pawl or air blowing separation means may similarly be used with the present invention. The detection means may be of either of optical or mechanical type. Further, the present invention is not limited to the manual sheet insertion type copying machine, but can be applied to another type of copying machines in which transfer sheets are supplied to the transfer station from a cassette or deck. The transfer sheet may be of plastic material rather than paper. Images to be transferred to transfer sheets may be of magnetic latent type or electrostatic latent type rather than toner type.

As will be understood from the foregoing, the present invention provides a new and novel flexure inhibiting member which cannot cause the transfer sheet to generate a flexure on itself and which can more stably feed various types of transfer sheets to obtain clearer images. Since the flexure inhibiting means according to the present invention improves the feed capacity of the copying machine, the sheet conveying section, gap in the path of sheet and others may be manufactured and assembled with less accuracy.

While the invention has been described with reference to the structures disclosed herein, it is not confined to the details set forth and this application is intended to cover such modifications or changes as may come within the purposes of the improvements or the scope of the following claims.

What is claimed is:

1. An apparatus for feeding sheets in a predetermined direction along a path, comprisng:

side guide means located beside the path of the sheet and contactable to a lateral edge of the sheet to guide the sheet in the predetermined direction;

advancing means for advancing the sheet while urging the sheet to said side guide means, by applying to the sheet a force having a component in the predetermined direction and a component perpendicular to the predetermined direction and toward said guide means;

bottom guide means having a top surface contactable to the sheet being advanced by said advancing means to guide it; and wrinkle preventing means disposed adjacent said advancing means and having a contactable surface which has a sufficiently larger length in the perpendicular direction as comapred with a length measured in the predetermined direction, and which is contactable to a top surface of the sheet and is adapted to urge it toward the bottom guide, thereby to prevent wrinkling of the sheet.

2. An apparatus according to claim 1 wherein said wrinkle preventing means urges the sheet in a range between said force applying means and said side guide means.

3. An apparatus according to claim 2, wherein said wrinkle preventing means is disposed upstream of said force applying means with respect to advancement of the sheet.

4. An apparatus according to claim 2, wherein said wrinkle preventing means is disposed between said force applying means and said side guide means.

5. An apparatus according to claim 2, wherein said wrinkle preventing means is disposed downstream of said force applying means.

6. An apparatus according to any one of claims 3-5, wherein said wrinkle preventing means includes a plate having a part-circular end.

7. An apparatus according to claim 6, wherein the wrinkle preventing means urges the sheet by its own weight.

8. An apparatus according to any one of claims 3-5, wherein said wrinkle preventing means includes a freely rotatable roll.

9. An apparatus according to claim 8, wherein said wrinkle preventing means urges the sheet by its own weight.

10. An apparatus according to claim 9, wherein said force applying means includes a plurality of rollers.

11. An apparatus according to claim 10, wherein said rollers are normally spaced apart, and at least one of them shifts to grip the sheet when it is passed, and wherein said wrinkle preventing means shifts toward and away from said bottom guide means in association with shifting of said at least one of said rolles.

12. An apparatus according to claim 11 wherein the sheet is an image transfer material manually fed to said applying means.

* * * * *

UNITED STATES PATENT AND TRADEMARK OFFICE

CERTIFICATE OF CORRECTION

PATENT NO. : 4,676,498

DATED : June 30, 1987

INVENTOR(S) : SHINJI KANEMITSU, ET AL.

It is certified that error appears in the above-identified patent and that said Letters Patent is hereby corrected as shown below:

Column 3, line 58, "drived" should read --driven--;
line 62, "was" should read --were--.
Column 6, line 17, "8" should read --8 mm--.
Column 7, line 12, "easily" should read --easily be--;
line 28, "interferenced" should read --interferenced with--;
line 35, "of" should be deleted;
line 39, "machines" should read --machine--.
Column 8, line 19, "comapred" sould read --compared--.

Signed and Sealed this

Twenty-seventh Day of October, 1987

*Attest:*

*Attesting Officer*

DONALD J. QUIGG

*Commissioner of Patents and Trademarks*